US011427420B2

(12) United States Patent
Onishi et al.

(10) Patent No.: US 11,427,420 B2
(45) Date of Patent: Aug. 30, 2022

(54) SHEET HANDLING APPARATUS

(71) Applicant: Glory Ltd., Himeji (JP)

(72) Inventors: Shuji Onishi, Himeji (JP); Yusuke Yoshida, Himeji (JP)

(73) Assignee: GLORY LTD., Himeji (JP)

( * ) Notice: Subject to any disclaimer, the term of this patent is extended or adjusted under 35 U.S.C. 154(b) by 58 days.

(21) Appl. No.: 17/030,389

(22) Filed: Sep. 24, 2020

(65) Prior Publication Data

US 2021/0009371 A1 Jan. 14, 2021

Related U.S. Application Data

(63) Continuation of application No. PCT/JP2018/012733, filed on Mar. 28, 2018.

(51) Int. Cl.

| | |
|---|---|
| ***B65H 5/02*** | (2006.01) |
| ***B65H 5/06*** | (2006.01) |
| ***B65H 29/00*** | (2006.01) |

(52) U.S. Cl.

CPC ..... *B65H 5/025* (2013.01); *B65H 5/062* (2013.01); *B65H 29/00* (2013.01); *B65H 2403/42* (2013.01)

(58) Field of Classification Search

CPC ..... B65H 5/025; B65H 5/062; B65H 5/023

See application file for complete search history.

(56) References Cited

U.S. PATENT DOCUMENTS

| | | | | |
|---|---|---|---|---|
| 8,919,769 | B2 | 12/2014 | Zubarevich et al. | |
| 11,111,093 | B2 * | 9/2021 | Ichikawa | B65H 3/5261 |
| 11,180,332 | B2 * | 11/2021 | Shiraiwa | B65H 5/062 |
| 2012/0242031 | A1 | 9/2012 | Taniguchi | |

FOREIGN PATENT DOCUMENTS

| | | | | |
|---|---|---|---|---|
| JP | 05-178531 | A | 7/1993 | |
| JP | 09-030687 | A | 2/1997 | |
| JP | 2001-294353 | A | 10/2001 | |
| JP | 2002-240975 | A | 8/2002 | |
| WO | 2011/036805 | A1 | 3/2011 | |
| WO | WO-2017042965 | A1 * | 3/2017 | B65H 29/006 |

OTHER PUBLICATIONS

International Search Report and Written Opinion dated Jun. 5, 2018 for PCT/JP2018/012733 filed on Mar. 28, 2018, 11 pages including English Translation of the International Search Report.

* cited by examiner

*Primary Examiner* — Howard J Sanders
(74) *Attorney, Agent, or Firm* — Xsensus LLP

(57) ABSTRACT

A sheet handling apparatus includes: a transport path along which a sheet is transported; a first transport member disposed on one side of the transport path; and a second transport member disposed opposed to the first transport member with the transport path interposed therebetween. The first transport member and the second transport member are driven to rotate. The sheet is transported by the first transport member rotating with an outer peripheral surface thereof being in contact with a first face of the sheet, and by the second transport member rotating in a direction opposite to a rotation direction of the first transport member, with an outer peripheral surface thereof being in contact with a second face of the sheet different from the first face.

10 Claims, 8 Drawing Sheets

SHEET HANDLING APPARATUS

CROSS REFERENCE TO RELATED APPLICATIONS

The present application is a continuation of, and claims priority to, International application PCT/JP2018/012733, filed Mar. 28, 2018, the entire contents of which being incorporated herein by reference.

TECHNICAL FIELD

The present disclosure relates to a sheet handling apparatus that transports sheets along a transport path.

BACKGROUND ART

Conventionally, a sheet handling apparatus that transports sheets along a transport path and performs recognition and storage of the sheets has been used. The sheets to be handled by the sheet handling apparatus are, for example, banknotes and checks. In a sheet handling apparatus disclosed in PCT International publication No. WO2011/036805, sheets fed into the apparatus from an inlet are transported along a transport path, and are recognized by a recognition unit disposed on the transport path. The recognition unit recognizes the kind and the degree of damage of each sheet. Based on the result of the sheet recognition, the sheets are stored in a sheet stacking unit or a sheet temporary storage unit. Counterfeit sheets and sheets that cannot be recognized are handled as reject sheets. The reject sheets are stacked in a bundled state in the sheet stacking unit, and thereafter are returned in the bundled state from the inlet. Meanwhile, sheets to be transported to another apparatus connected to the sheet handling apparatus are temporarily stored in the sheet temporary storage unit, and thereafter are fed out one by one from the sheet temporary storage unit and transported to the other apparatus.

The sheets on the transport path are transported by transport members. Rollers and belts are used as the transport members. For example, a pair of rollers is disposed such that two rollers are opposed to each other with the transport path formed therebetween. When a driving unit drives one of the opposed rollers to rotate, the other roller, whose outer peripheral surface is in contact with that of the rotated roller, also rotates. The sheets pass between the two rotating rollers, and are transported along the transport path. Meanwhile, for example, a transport belt, and one or a plurality of rollers are disposed opposed to each other with the transport path formed therebetween. When the driving unit drives and rotates one of rollers over which the transport belt is extended, the transport belt rotates. When the transport belt rotates, a roller, whose outer peripheral surface is in contact with a surface of the transport belt, also rotates. The sheets pass between the rotating transport belt and the rotating roller, and are transported along the transport path.

SUMMARY

As recognized by the present inventors, in the above conventional art, however, jamming of sheets sometimes occurs in the transport path, which makes the sheet handling apparatus unable to transport the sheets. For example, there are cases where a sheet whose leading end in the transport direction is folded and increased in thickness or a sheet that is folded multiple times in a corrugated fashion, cannot pass between the two rollers opposed to each other with the transport path formed therebetween.

The present disclosure is made in view of the above-described problem, as well as other problems, of the above conventional art, and the present disclosure addresses these issues, as discussed herein, with a sheet handling apparatus capable of preventing occurrence of jamming of sheets in a transport path.

In order to solve the aforementioned, and other problems, a sheet handling apparatus includes: a first transport member having an outer peripheral surface that rotates in a first direction in response to the first transport member being driven; and a second transport member having an outer peripheral surface that rotates in a second direction in response to the second transport member being driven, the second direction being opposite to the first direction, wherein the second transport member disposed opposed to the first transport member such that a transport path that conveys a sheet is formed between the outer peripheral surface of the first transport member and the outer peripheral surface of the second transport member, and the outer peripheral surface of the first transport member and the outer peripheral surface of the second member being configured to convey the sheet along the transport path in response to the first transport member and the second transport member being driven while a first face of the sheet remains in contact with the outer peripheral surface of the first transport member, and a second face of the sheet remains in contact with the outer peripheral surface of the second member.

The sheet handling apparatus according to the present disclosure drives and rotates both the first transport member and the second transport member disposed opposed to each other with the transport path interposed therebetween. A sheet having two faces, i.e., the first face and the second face (front face and back face), is transported by the first transport member that is driven to rotate with the outer peripheral surface thereof being in contact with the first face, and by the second transport member that is driven to rotate in the direction opposite to the direction of rotation of the first transport member, with the outer peripheral surface thereof being in contact with the second face. Since the rotating transport members apply transport force to both faces of the sheet, the sheet is reliably transported, thereby preventing occurrence of jamming.

DESCRIPTION OF EMBODIMENTS

Hereinafter, embodiment of a sheet handling apparatus according to the present disclosure will be described with reference to the accompanying drawings. The sheet handling apparatus is an apparatus for handling sheets. The sheets to be handled by the sheet handling apparatus are, for example, banknotes and checks. Hereinafter, a banknote handling apparatus for handling banknotes will be described as an example.

A banknote handling apparatus (sheet handling apparatus) according to the present embodiment is characterized in that a plurality of transport members disposed opposed to each other with a transport path interposed therebetween are driven to rotate, thereby transporting a banknote (sheet) with a transport force acting on both faces of the banknote. The transport members are members for transporting banknotes along the transport path. For example, a roller can be used as the transport member. The driving unit (or driving source) drives the roller to rotate. For another example, a belt extended over a plurality of rollers can be used as the transport member. In this case, the driving unit rotates the rollers over which the belt is extended, thereby driving the belt to rotate. For example, the driving unit for driving the transport members is an actuator including a motor. The banknote handling apparatus drives the transport member to rotate and causes outer peripheral surfaces of the transport members being driven to be in contact with the faces of the banknote, thereby applying a transport force to the sheet. The transport force is a force applied to the banknote in the transport direction by the transport members. While rollers and/or belts are usable as the transport members, a case of using rollers will be described below.

Figure 1:
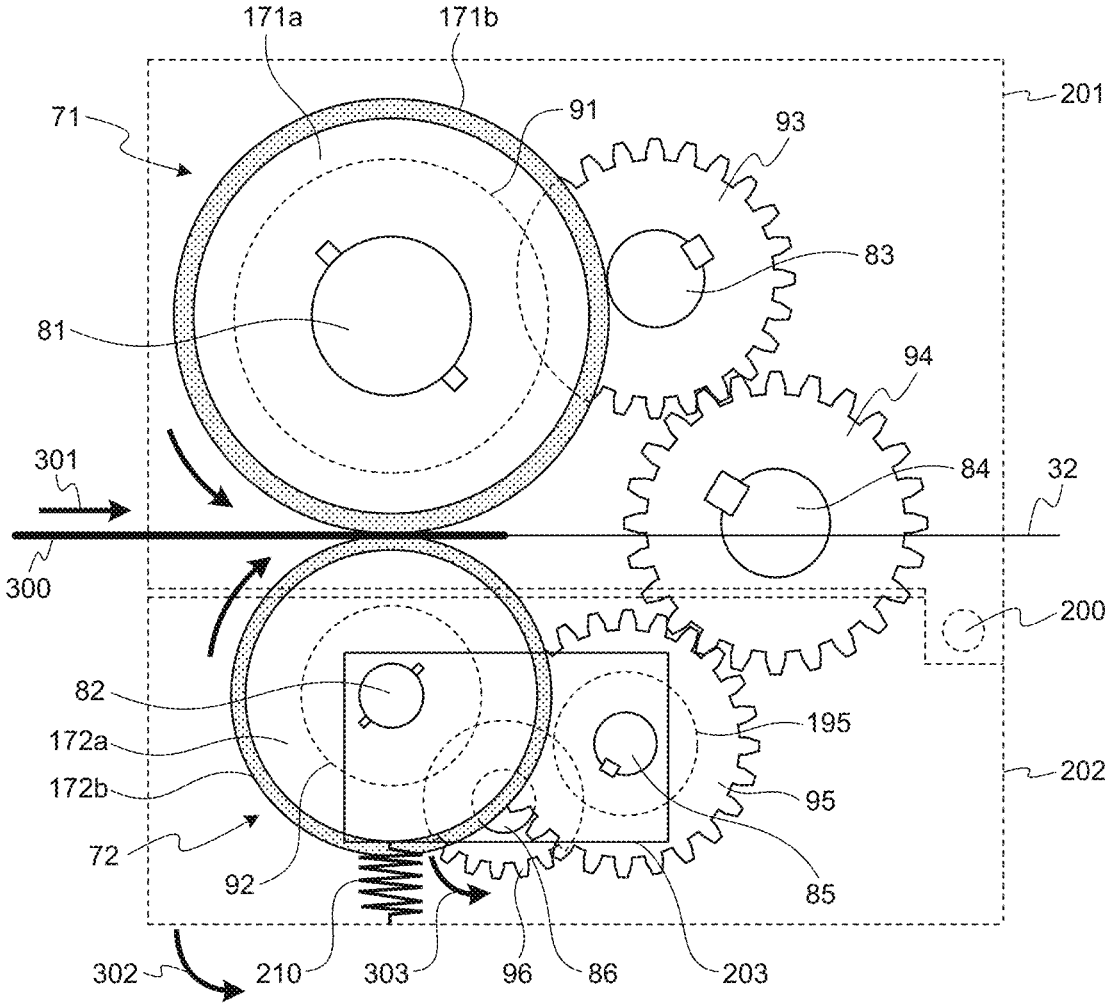
FIG. 1 is a schematic diagram illustrating a first drive roller and a second drive roller disposed inside a banknote handling apparatus.

FIG. 1 is a schematic diagram illustrating a first drive roller 71 and a second drive roller 72 disposed inside a banknote handling apparatus. FIG. 1 shows a transport path 32 as viewed from a lateral side. A banknote 300 is transported along the transport path 32 in a transport direction 301 indicated by an arrow. The banknote 300 can be also transported in a direction opposite to the transport direction 301. The first drive roller 71 and the second drive roller 72 are disposed opposed to each other with outer peripheral surfaces thereof being in contact with each other.

The first drive roller 71 is fixed to a rotating shaft (or rotation shaft) 81 made of metal. The first drive roller 71 is composed of a cylindrical main body 171*a* and an outer peripheral part 171*b*. The main body 171*a* is made of resin. The outer peripheral part 171*b* is made of rubber and fixed to an outer peripheral surface of the main body 171*a*. Rubber having a shore A hardness (measured by a durometer, type A) of 50° or lower can be used as the outer peripheral part 171*b*. For example, urethane rubber having a shore A hardness of 50° is used as the outer peripheral part 171*b*. A method of fixing the outer peripheral part 171*b* to the main body 171*a* is not particularly limited as long as the outer peripheral part 171*b* can rotate together with the main body 171*a*. For example, the outer peripheral part 171*b* is formed so as to be fixed to the main body 171*a* through a technique such as adhesion, coating, integral molding, or fitting in which a part of the outer peripheral part 171*b* is inserted into a groove formed in the main body 171*a*.

The second drive roller 72 is fixed to a rotating shaft 82 made of metal and disposed parallel to the rotating shaft 81. The second drive roller 72 is composed of a cylindrical main body 172*a* and an outer peripheral part 172*b*. The main body 172*a* is made of resin. The outer peripheral part 172*b* is made of rubber and fixed to an outer peripheral surface of the main body 172*a*. Rubber having a shore A hardness of 35° or lower can be used as the outer peripheral part 172*b*. For example, EPDM (Ethylene Propylene Diene Monomer) rubber having a shore A hardness of 35° is used as the outer peripheral part 172*b*. Like the first drive roller 71, the outer peripheral part 172*b* of the second drive roller 72 is fixed to the main body 172*a*.

The sizes of the first drive roller 71 and the second drive roller 72 are not particularly limited. For example, a cylindrical roller having a diameter of 27 mm and a thickness of 3.5 mm is used as the first drive roller 71, and a cylindrical roller having a diameter of 20 mm and a thickness of 3.5 mm is used as the second drive roller 72. The thicknesses of the outer peripheral parts 171*b*, 172*b* in the radial direction are also not particularly limited. For example, the thicknesses are 2 to 3 mm.

The first drive roller 71 and the second drive roller 72 are driven to rotate by using a plurality of gears 91 to 96, and 195 (intermediate gears). A gear 91 is fixed to the rotating shaft 81 to which the first drive roller 71 is fixed. A gear 92 is fixed to the rotating shaft 82 to which the second drive roller 72 is fixed. Four rotating shafts 83 to 86 are disposed in parallel to the rotating shaft 81 and the rotating shaft 82. Gears 93 to 96 are fixed to the four rotating shafts 83 to 86, respectively. Still another gear 195 is fixed to the rotating shaft 85.

The plurality of gears 91 to 96, and 195 and the plurality of rotating shafts 81 to 86 form a drive mechanism (or drive coupling) for driving the first drive roller 71 and the second drive roller 72. A drive force is transmitted from the driving unit to one of the rotating shafts 81 to 86. This drive force is transmitted to the first drive roller 71 and the second drive roller 72 through the gears 91 to 96, and 195. That is, the first drive roller 71 and the second drive roller 72 are driven to rotate by the driving unit and the drive mechanism.

When the drive force of the driving unit is transmitted through the drive mechanism including the gears 91 to 96, and 195 and thereby the first drive roller 71 shown in FIG. 1 rotates counterclockwise, the second drive roller 72 rotates clockwise. The number of teeth of each of the seven gears 91 to 96, and 195 is set such that the circumferential speed of the first drive roller 71 is the same as the circumferential speed of the drive roller 72. The circumferential speed is set based on the transport speed of the banknote 300 transported along the transport path 32. Specifically, the circumferential speed is set according to the banknote transport speed such that, when each of a plurality of banknotes being transported along the transport path 32 sequentially passes between the first drive roller 71 and the second drive roller 72, these banknotes are smoothly transported.

When the banknote 300 is transported, an outer peripheral surface of the first drive roller 71 is in contact with one of the banknote faces and an outer peripheral surface of the second drive roller 72 is in contact with the other banknote face, and the first drive roller 71 and the second drive roller 72 are rotated at the same circumferential speed in a direction of sending the banknote 300 in the transport direction 301. A tangential force acts on the banknote 300 passing through a contact point between the first drive roller 71 and the second drive roller 72. That is, a transport force that causes the banknote 300 to move in the transport direction 301 at the same speed, acts on each of the front face and the back face of the banknote 300. The banknote 300, which receives the transport force at both faces, is transported in the transport direction 301. When the banknote 300 is transported in the direction opposite to the transport direction 301, the first drive roller 71 and the second drive roller 72 are driven to rotate in the reverse directions of those for transporting the banknote 300 in the transport direction 301.

The number of rotating shafts included in the drive mechanism, the positions of the respective rotating shafts, the number of gears fixed to each rotating shaft, and the number of teeth of each gear are not particularly limited as long as the circumferential speed of the first drive roller 71 is the same as the circumferential speed of the second drive roller 72, and the first drive roller 71 and the second drive roller 72 rotate in opposite directions. The drive mechanism may use a transmission mechanism other than the gears. For example, belts may be used instead of or in addition to the gears.

The sheet handling apparatus includes a first unit 201 and a second unit 202 which are indicated by broken lines in FIG. 1. The first unit 201 and the second unit 202 are connected to each other by a support shaft 200. When handling banknotes, the first unit 201 and the second unit 202 are fixed with a predetermined positional relationship shown in FIG. 1. When this fixation is released, the second unit 202 can be pivoted around the support shaft 200 as indicated by an arrow 302 in FIG. 1. When the second unit 202 is pivoted, engagement of the gear 94 and the gear 95 is released. When the second unit 202 is pivoted, the transport path 32 is opened. For example, when a foreign material enters the transport path 32 or a banknote stays in transport path 32, a user of the banknote handling apparatus can pivot the second unit 202 and take out the foreign material or the banknote from the transport path 32.

The rotating shaft 81 of the first drive roller 71 and two rotating shafts 83, 84 are rotatably supported in the first unit 201. In the second unit 202, one rotating shaft 85 is rotatably supported.

In the second unit 202, a third unit 203 supported by the rotating shaft 85 is disposed. The third unit 203 is supported swingably around the rotating shaft 85. The rotating shaft 82 of the second drive roller 72 and the two rotating shafts 85, 86 are rotatably supported by the third unit 203. The third unit 203 functions as a support member for supporting the second drive roller 72.

An urging member 210 is disposed between the third unit 203 and the second unit 202. The urging member 210 urges the third unit 203 clockwise around the rotating shaft 85. That is, the urging member 210 urges the second drive roller 72 toward the first drive roller 71. The type of the urging member 210 is not particularly limited, and may generally be referred to as a bias member. For example, a spring member such as a compression coil spring or a plate spring may be mounted to the lower side of the third unit 203 as shown in FIG. 1. Alternatively, for example, a tension coil spring may be mounted to the upper side of the third unit 203 shown in FIG. 1.

Since the urging member 210 urges the third unit 203, the outer peripheral surface of the second drive roller 72 is in contact with and pressed against the outer peripheral surface of the first drive roller 71 when no banknote is present therebetween. As indicated by an arrow 303 in FIG. 1, when the banknote 300 passes between the first drive roller 71 and the second drive roller 72, the third unit 203 can pivot counterclockwise around the rotating shaft 85 against the urging by the urging member 210. Thus, a gap can be formed between the first drive roller 71 and the second drive roller 72. The banknote 300 can pass through this gap. After the banknote 300 has passed through the gap, the third unit 203 pivots clockwise around the rotating shaft 85 while being urged by the urging member 210. Thus, the outer peripheral surface of the second drive roller 72 and the outer peripheral surface of the first drive roller 71 are again in contact with each other.

The third unit 203 pivots around the rotating shaft 85 to which the gear 95 and the gear 195 (third gear) are fixed. Therefore, even while the third unit 203 is pivoting due to passing of the banknote 300, transmission of the drive force through the gears 91 to 96, and 195 is maintained, and the first drive roller 71 and the second drive roller 72 continue to rotate.

Conventionally, only one of two rollers disposed opposed to each other with a transport path formed therebetween is driven to rotate. The outer peripheral surface of this one roller comes into contact with the outer peripheral surface of the other roller and therefore, the other roller is made to rotate together with the one roller. While a banknote passes between these two rollers, a gap is formed between the two rollers and only the one roller is driven to rotate. That is, conventionally, one roller of a pair of two rollers is driven to rotate and applies a transport force to the banknote, the banknote moves in the transport direction by the transport force, and the moving banknote rotates the other roller. In contrast to the conventional art, in the banknote handling apparatus according to the present embodiment, both the first drive roller 71 and the second drive roller 72 are constantly driven to rotate even while the banknote 300 passes between the first drive roller 71 and the second drive roller 72. As a result, the transport force acts on both faces of the banknote 300, and the banknote 300 is reliably transported.

Figure 2:
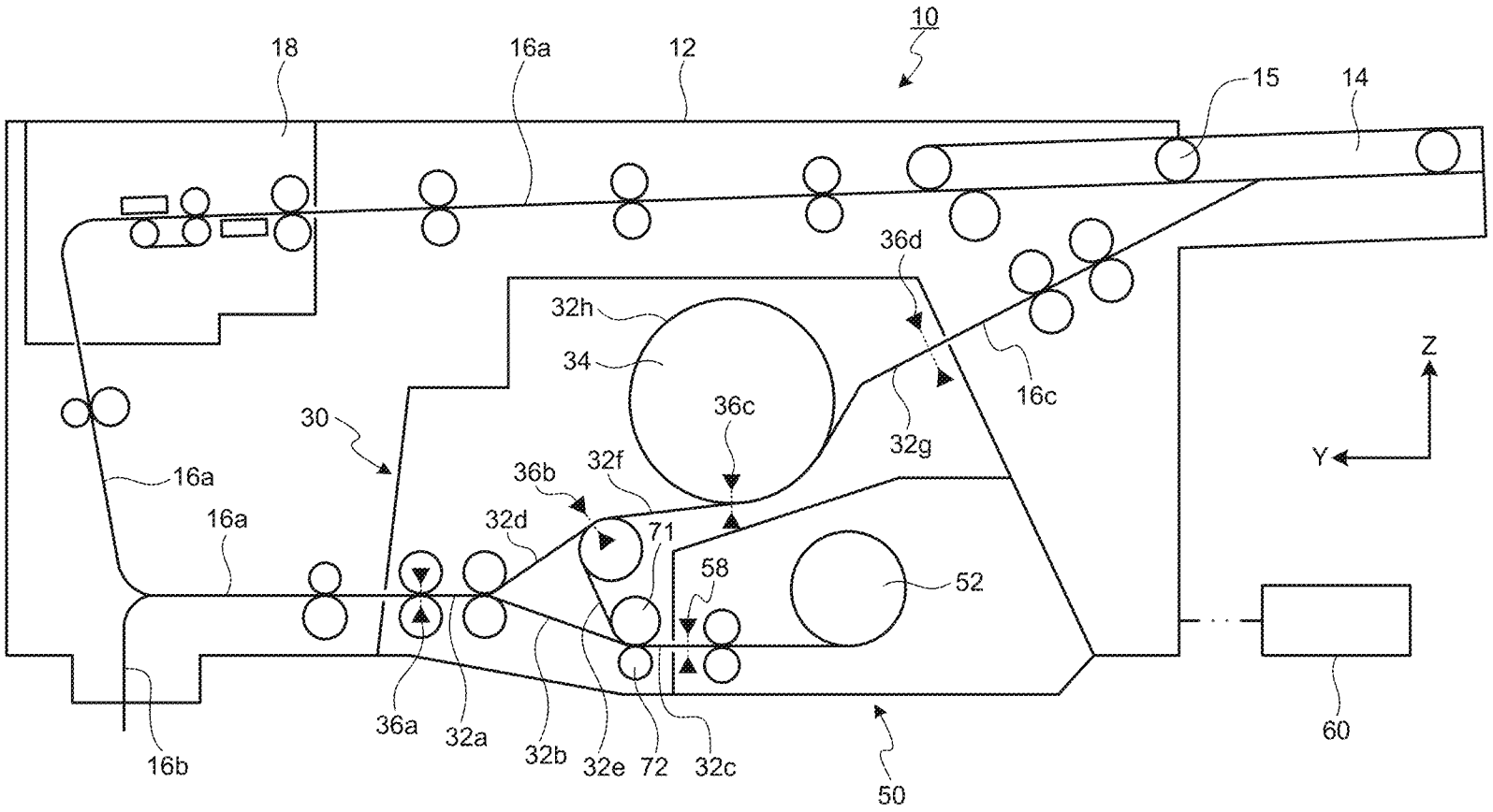
FIG. 2 is a schematic diagram illustrating a configuration of the banknote handling apparatus.

Next, the specific configuration of the banknote handling apparatus will be described. FIG. 2 is a schematic diagram illustrating the configuration of the banknote handling apparatus 10. Hereinafter, each figure showing the configuration of the banknote handling apparatus 10 is provided with coordinate axes of an orthogonal coordinate system so that correspondence between figures is understood. In FIG. 2, the up-down direction is a Z-axis direction, the left-right direction is a Y-axis direction, and the direction from the near side to the far side in the drawing is an X-axis positive direction.

As shown in FIG. 2, the banknote handling apparatus 10 includes an inlet 14, a feeding unit 15, a transport path 16 (16*a* to 16*c*), a recognition unit 18 (or detector), a stacking unit 30 (or stacker), a temporary storage unit 50, and a control unit 60. A banknote on the transport path 16 is transported by transport members.

A plurality of banknotes to be handled by the banknote handling apparatus 10 are placed in a bundle form on the inlet 14. The feeding unit 15 feeds the banknotes placed on the inlet 14 one by one to a transport path 16*a* disposed in a housing 12. The banknotes fed by the feeding unit 15 are transported along the transport path 16*a* in the housing 12. The recognition unit 18 recognizes the denomination of each banknote transported along the transport path 16*a*. The recognition unit 18 may recognize other features of the banknote. For example, the recognition unit 18 can recognize at least one feature of authenticity, fitness (degree of damage), and a serial number of the banknote. A banknote recognition result obtained by the recognition unit 18 is inputted to the control unit 60.

A transport path 16*b* and a transport path 16*c* are connected to the transport path 16*a*. The transport path 16*b* may be connected to a not shown storage unit. The transport path 16*b* may be connected to a transport path that transports banknotes to the outside of the housing 12. For example, the banknote handling apparatus 10 is disposed inside an ATM (Automated Teller Machine) and used in the ATM. The banknotes transported through the transport path 16*b* are stored in a storage unit in the ATM.

The transport path 16*c* connects the inlet 14 to the stacking unit 30. The stacking unit 30 stacks banknotes to be returned outside of the apparatus 10 from the inlet 14 such that the banknotes are stacked in a bundled state in which the leading ends or the rear ends thereof being aligned. For example, banknotes to be rejected and counterfeit banknotes are handled as the banknotes to be returned. The bundle of the banknotes stacked in the stacking unit 30 is transported along the transport path 16*c* while being kept in a bundle form. These banknotes are discharged to the inlet 14 while being kept in the bundle form.

A plurality of transport paths 32 (32*a* to 32*h*) are disposed in the stacking unit 30. A transport path 32*a* is connected to the transport path 16*a*. Two transport paths 32*b*, 32*d* diverge from the transport path 32*a*. The transport path 32*b* is connected to a transport path 32*c*. The transport path 32*c* is connected to the temporary storage unit 50. A transport path 32*e* is connected to a point where the transport path 32*b* and the transport path 32*c* are connected. The transport path 32*d* joins the transport path 32*e*. A transport path 32*f* is connected to this joining point. A loop-shaped transport path 32*h* is connected to the transport path 32*f*. A cylindrical rotor 34 is disposed in the stacking unit 30. The transport path 32*h* is formed along the outer peripheral surface of this rotor 34. A transport path 32*g* diverges from the loop-shaped transport path 32*h*. The transport path 16*c* is connected to the transport path 32*g*. The banknotes sent from the transport path 32*g* to the transport path 16*c* are returned from the inlet 14.

Figure 3:
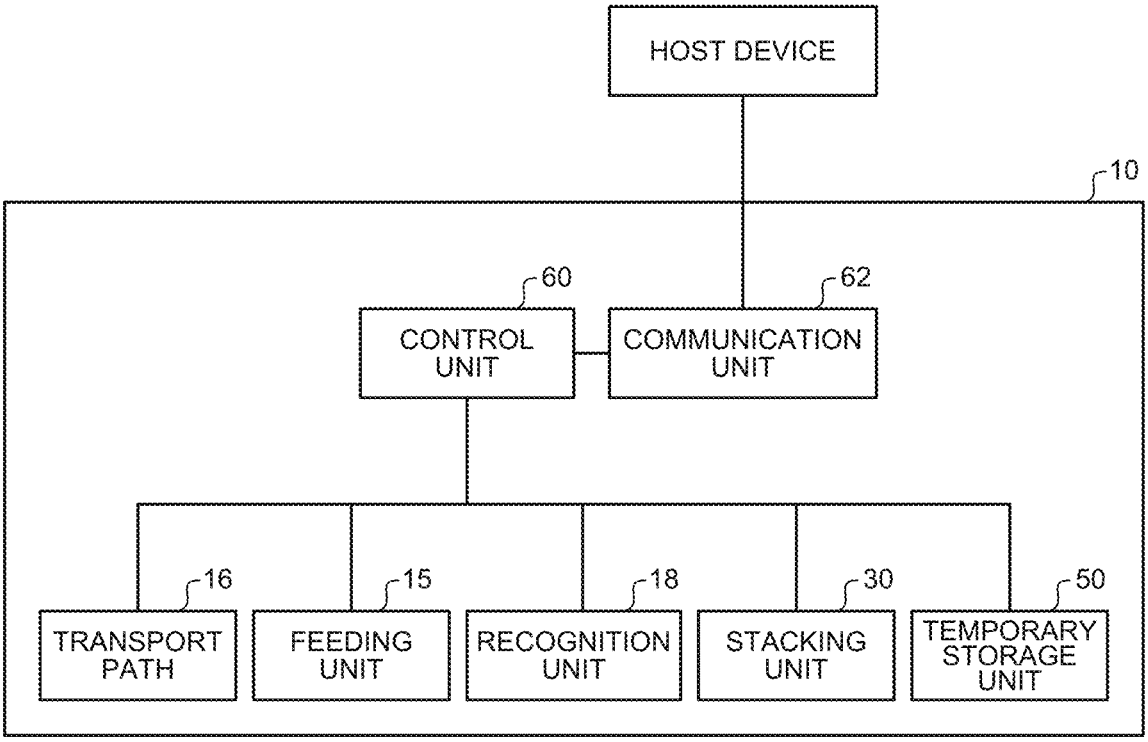
FIG. 3 is a block diagram illustrating a functional configuration of the banknote handling apparatus.

FIG. 3 is a block diagram illustrating a functional configuration of the banknote handling apparatus 10. As shown in FIG. 3, the control unit 60 controls the feeding unit 15, the recognition unit 18, the stacking unit 30, and the temporary storage unit 50. The control unit 60 controls, for example, transport of banknotes along the transport paths 16*a* to 16*c*, and transport of banknotes along the transport path 32 in the stacking unit 30. Specifically, the control unit 60 controls the driving unit that drives and rotates the transport members disposed on the transport paths, thereby transporting the banknotes along the transport paths. The control unit 60 may be operated according to a command received from a host device of the banknote handling apparatus 10 via a communication unit 62. The host device is, for example, a money handling machine such as an ATM, a money changer, or an operation terminal.

Figure 4:
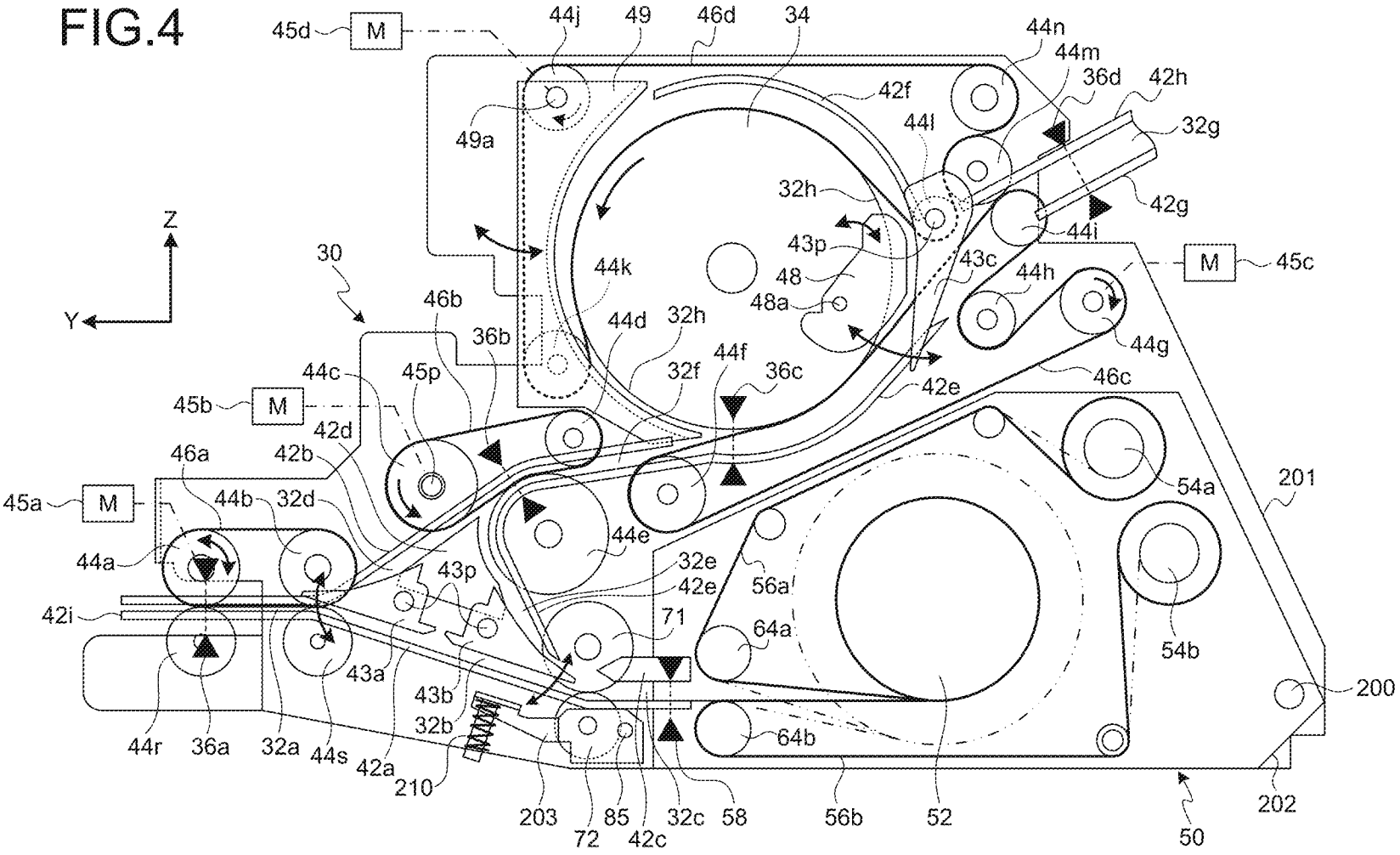
FIG. 4 is a schematic cross-sectional view illustrating configurations and operations of a stacking unit and a temporary storage unit.

FIG. 4 is a schematic cross-sectional view illustrating configurations and operations of the stacking unit 30 and the temporary storage unit 50. The stacking unit 30 is provided with a plurality of guide members 42 (42*a* to 42*i*) for guiding banknotes transported on the transport path 32. As shown in FIG. 4, the transport path 32*a* is formed between a guide member 42*b* and a guide member 42*i*. The transport path 32*c* is formed between a guide member 42*a* and a guide member 42*c*. The transport path 32*d* is formed between the guide member 42*b* and a guide member 42*d*. The transport path 32*e* is formed between the guide member 42*d* and a guide member 42*e*. The transport path 32*f* is formed between the guide member 42*b* and the guide member 42*e*. A guide member 42*f* is formed along the outer peripheral surface of the rotor 34. The transport path 32*g* is formed between a guide member 42*g* and a guide member 42*h*.

The stacking unit 30 is provided with a plurality of rollers 44 (44*a* to 44*n*, 44*r*, 44*s*) and a plurality of belts 46 (46*a* to 46*d*). The belts 46 are driven to rotate by motors 45 (45*a* to 45*d*). The first drive roller 71 and the second drive roller 72 shown in FIG. 1 are disposed on the transport path 32*c* in the stacking unit 30.

An endless belt 46*a* is extended over a roller 44*a* and a roller 44*b*. A banknote on the transport path 32*a* is transported by the belt 46*a*. The roller 44*a* is connected to a motor 45*a*. The motor 45*a* rotates the roller 44*a* clockwise, thereby driving the belt 46*a* to rotate clockwise. In addition, the motor 45*a* can rotate the roller 44*a* counterclockwise, thereby driving the belt 46*a* to rotate counterclockwise. The control unit 60 controls the motor 45*a*. Rollers 44*r*, 44*s* are disposed at positions opposed to the rollers 44*a*, 44*b*, respectively, with the transport path 32*a* interposed therebetween. The rollers 44*r*, 44*s* contact with the rollers 44*a*, 44*b*, respectively, via the belt 46*a*.

An endless belt 46*b* is extended over a roller 44*c* and a roller 44*d*. Banknotes on the transport paths 32*d* and 32*f* are transported by the belt 46*b*. The roller 44*c* is connected to a motor 45*b* via a one-way clutch 45*p*. The motor 45*b* rotates the roller 44*c* counterclockwise, thereby driving the belt 46*b* to rotate counterclockwise. Even while the motor 45*b* is stopped, the roller 44*c* and the belt 46*b* can be rotated counterclockwise. The control unit 60 controls the motor 45*b*. The outer peripheral surface of a roller 44*e* contacts with the outer peripheral surface of the belt 46*b* which is opposed to the roller 44*e* with the transport path 32*f* formed therebetween. When the belt 46*b* rotates counterclockwise, the roller 44*e* rotates clockwise.

The endless belt 46*c* is extended over a roller 44*f*, a roller 44*g*, a roller 44*h*, and a roller 44*i*. Banknotes on the transport paths 32*f*, 32*g*, and 32*h* are transported by the belt 46*c*. The roller 44*i* is capable of advancing and retracting with respect to a roller 44*m*. The roller 44*i* moves according to the thickness of a bundle of banknotes transported on the transport path 32*g*. The roller 44*g* is connected to a motor (stepping motor) 45*c*. The motor 45*c* rotates the roller 44*g* clockwise, thereby driving the belt 46*c* to rotate. The control unit 60 controls the motor 45*c*. A part of the outer peripheral surface of the rotor 34 contacts with the outer peripheral surface of the belt 46*c*. A part of the transport path 32*h* is formed between the belt 46*c* and the rotor 34.

An endless belt 46*d* is extended over a roller 44*j*, a roller 44*k*, a roller 44*l*, a roller 44*m*, and a roller 44*n*. Banknotes are transported along the transport path 32*h* by the belt 46*d*. The roller 44*j* is connected to the motor (stepping motor) 45*d*. The motor 45*d* rotates the roller 44*j* clockwise, thereby driving the belt 46*d* to rotate. The control unit 60 controls the motor 45*d*. A part of the outer peripheral surface of the rotor 34 contacts with the outer peripheral surface of the belt 46*d*. A part of the transport path 32*h* is formed between the belt 46*d* and the rotor 34. The outer peripheral surface of the belt 46*c* and the outer peripheral surface of the belt 46*d* contact with the outer peripheral surface of the rotor 34. When the belts 46*c*, 46*d* are driven to rotate, the rotor 34 is rotated counterclockwise in the drawing.

Diverters 43 (43*a* to 43*c*) for controlling transport destinations of banknotes are disposed at diverging points of the transport path 32. The control unit 60 controls the diverters 43. Each diverter 43 swings around a shaft 43*p* as shown by an arrow in FIG. 4. The transport path 32*b* is formed between the guide member 42*a*, and diverters 43*a* and 43*b*.

The diverter 43*a* is disposed at a point where the transport paths 32*b*, 32*d* diverge from the transport path 32*a*. A banknote which has been transported from the transport path 32*a* is transported to the transport path 32*b* or the transport path 32*d* by the diverter 43*a*. The diverter 43*b* is disposed at a point where the transport paths 32*b*, 32*e* diverge from the transport path 32*c*. A banknote which has been transported from the transport path 32*c* is transported to the transport path 32*b* or the transport path 32*e* by the diverter 43*b*.

A diverter 43*c* is disposed at a point where the transport path 32*g* diverges from the loop-shaped transport path 32*h*. The diverter 43*c* controls whether transport of the banknote along the transport path 32*h* is continued or the banknote is transported from the transport path 32*h* to the transport path 32*g*.

Specifically, when the diverter 43*c* is in the state shown in FIG. 4, transport of the banknote along the transport path 32*h* is continued. When the diverter 43*c* in the state shown in FIG. 4 has pivoted clockwise around the shaft 43*p*, the banknote having been transported along the transport path 32*h* is transported to the transport path 32*g* by the belt 46*c*. The banknote transported to the transport path 32*g* is discharged to the inlet 14 through the transport path 16*c*.

The transport path 32 in the stacking unit 30 is provided with a plurality of banknote detection sensors 36 (36*a* to 36*d*) for detecting banknotes. For example, each banknote detection sensor 36 is an optical sensor including a light emitter and a light receiver. A banknote detection result obtained by the banknote detection sensor 36 is inputted to the control unit 60 and used for banknote transport control.

The transport path 32*h* in the stacking unit 30 is provided with two width adjustment members 48, 49. The width adjustment members 48, 49 adjust the width of the transport path 32*h* according to the number of banknotes transported on the transport path 32*h*.

The width adjustment member 48 swings around a shaft 48*a*. The width adjustment member 48 is urged clockwise by an urging member. For example, a torsion spring is used as the urging member. The width adjustment member 48 urged by the urging member is usually maintained at the position shown in FIG. 4. When the number of banknotes transported along the transport path 32*h* increases and the thickness of the bundle of banknotes increases, the bundle of banknotes applies a force to the width adjustment member 48. The width adjustment member 48, to which the force is applied, pivots around the shaft 48*a* counterclockwise in the drawing. Thus, even when the number of banknotes transported along the transport path 32*h* increases, the bundle of banknotes can be transported without any problem.

The width adjustment member 49 swings around a shaft 49*a*. The width adjustment member 49 is urged counterclockwise by an urging member. For example, a torsion spring is used as the urging member. The width adjustment member 49 urged by the urging member is usually maintained at the position shown in FIG. 4. Like the width adjustment member 48, when the number of banknotes transported along the transport path 32*h* increases and the thickness of the bundle of banknotes increases, the width adjustment member 49 pivots clockwise around the shaft 49*a*. Thus, even when the number of banknotes transported along the transport path 32*h* increases, the bundle of banknotes can be transported along the transport path 32*h*. The roller 44*k* is mounted to the width adjustment member 49. When the width adjustment member 49 pivots around the shaft 49*a*, the roller 44*k* also pivots around the shaft 49*a*.

The temporary storage unit 50 is a tape-type storage/feeding unit. In the temporary storage unit 50, banknotes transported from the transport path 32*c* are sandwiched between a pair of tapes 56 (56*a*, 56*b*), and wound around a drum (rotor) to be stored. Meanwhile, the stored banknotes are fed to the transport path 32*c* by reversely rotating the drum 52.

A banknote detection sensor 58 for detecting banknotes is disposed near a banknote outlet/inlet of the temporary storage unit 50. For example, the banknote detection sensor 58 is an optical sensor including a light emitter and a light receiver. The banknote detection sensor 58 detects a banknote sent from the transport path 32*c* to the temporary storage unit 50, and a banknote sent from the temporary storage unit 50 to the transport path 32*c*. A banknote detection result obtained by the banknote detection sensor 58 is inputted to the control unit 60 and used for banknote transport control.

An end of the tape 56*a* and an end of the tape 56*b* are attached to the same part on the outer peripheral surface of the drum 52. The other end of the tape 56*a* is attached to a reel 54*a* while the other end of the tape 56*b* is attached to a reel 54*b*. While the one ends of the tapes 56*a*, 56*b* are wound around the same drum 52, the other ends thereof are wound around the separate reels 54*a*, 54*b*.

The running paths of the two tapes 56*a*, 56*b* are defined by a plurality of guide rollers. The plurality of guide rollers includes a pair of guide rollers 64*a*, 64*b*, disposed near the banknote inlet/outlet of the temporary storage unit 50. The rollers 64*a*, 64*b* fold back the tapes 56*a*, 56*b* drawn from the reels 54*a*, 54*b*, respectively, toward the drum 52. The tapes 56*a*, 56*b*, folded back by the guide rollers 64*a*, 64*b*, form a part of the transport path 32*c* and sandwich the banknotes transported along the transport path 32*c*. The guide roller 64*a* and the guide roller 64*b* are disposed spaced apart from each other in the height direction of the transport path 32*c*. Between the drum 52 and the guide rollers 64*a*, 64*b*, the tape 56*a* and the tape 56*b* run with a slight space therebetween. Within this space, the relative position of each banknote to the tapes 56*a*, 56*b* is variable. Thus, the transport speed of banknotes transported along the transport path 32*c* can be made different from the transport speed of banknotes transported by the tapes 56*a*, 56*b*. For example, when storing banknotes in the temporary storage unit 50, the interval between the stored banknotes in the temporary storage unit 50 can be reduced by changing the transport speed by the tapes 56*a*, 56*b* lower than the transport speed by the transport path 32*c*. Thus, the quantity of banknotes that can be stored in the temporary storage unit 50 is increased. The height of the transport path 32*c* is set according to the distance between the guide roller 64*a* and the guide roller 64*b*. The height of the transport path 32*c* is greater than the height of the transport path 32*b*.

Each of the drum 52, the reel 54*a*, and the reel 54*b* can be rotated clockwise and counterclockwise. The control unit 60 controls rotations of the drum 52, the reel 54*a*, and the reel 54*b*. When banknotes are temporarily stored in the temporary storage unit 50, the drum 52 rotates counterclockwise and winds up the tapes 56*a*, 56*b*. The banknotes sent from the transport path 32*c* into the temporary storage unit 50 are sandwiched between the pair of tapes 56*a*, 56*b*, and are wound onto the drum 52 together with the tapes 56*a*, 56*b* to be temporarily stored. In FIG. 4, a two-dot chain line shows the state where the most part of the pair of tapes 56*a*, 56*b* is wound onto the drum 52.

When the temporary storage is finished and the banknotes are fed out from the temporary storage unit 50, the reel 54*a* rotates counterclockwise, and the reel 54*b* rotates clockwise. The tapes 56*a*, 56*b* on the drum 52 are unwound by the rotations of the reels 54*a*, 54*b*, and the drum 52 rotates clockwise. The banknotes having been temporarily stored are released from between the pair of tapes 56*a*, 56*b*, and are fed one by one to the transport path 32*c*.

The banknotes on the transport path 32*c* are transported by the first drive roller 71 and the second drive roller 72. When the banknotes are to be temporarily stored in the temporary storage unit 50, the banknotes transported by the first drive roller 71 and the second drive roller 72 are sent from the transport path 32*c* into the temporary storage unit 50. When the banknotes are to be fed out from the temporary storage unit 50, the banknotes fed to the transport path 32*c* are transported by the first drive roller 71 and the second drive roller 72. These banknotes are sent to the transport path 32*b* or the transport path 32*e* by the diverter 43*b*.

In the case where the banknotes fed out from the temporary storage unit 50 are to be stored in the storage unit inside the apparatus, the banknotes are sent to the transport path 32*b*. These banknotes are transported from the transport path 16*b* toward the storage unit that is disposed outside the housing 12 and used in the ATM. In the case where the banknotes fed out from the temporary storage unit 50 are to be returned outside of the apparatus 10 from the inlet 14, the banknotes are sent to the transport path 32*e*. These banknotes are stacked in the stacking unit 30. The stacked banknotes are fed out from the stacking unit 30 and discharged to the inlet 14. Since the content of the banknote handling by the banknote handling apparatus 10 is described in WO2011-036805, detailed description thereof is omitted.

When a banknote passes through a position at which a plurality of transport paths 32*b*, 32*c*, and 32*e* are connected, the first drive roller 71 and the second drive roller 72 transport this banknote. The first drive roller 71 and the second drive roller 72 are connected to one motor (driving unit) 45*a* via the drive mechanism. The control unit 60 controls the motor 45*a*.

The drive force by the motor 45*a* is transmitted to the first drive roller 71 and the second drive roller 72 via the drive mechanism, whereby the first drive roller 71 and the second drive roller 72 are driven to rotate. When the banknote is temporarily stored in the temporary storage unit 50, the first drive roller 71 is driven to rotate counterclockwise, and the second drive roller 72 is driven to rotate clockwise. When the banknote is fed out from the temporary storage unit 50, the first drive roller 71 is driven to rotate clockwise, and the second drive roller 72 is driven to rotate counterclockwise.

The first drive roller 71 is rotatably supported by the first unit 201. The first unit 201 and the second unit 202 are connected to each other by the support shaft 200. The second unit 202 is rotatably supported by the support shaft 200. The rotating shaft 85 is rotatably supported by the second unit 202. The third unit 203 is rotatably supported by the rotating shaft 85. The second drive roller 72 is rotatably supported by the third unit 203. A compression spring (urging member) 210 is disposed between the third unit 203 and the second unit 202. The third unit 203 shown in FIG. 4 is urged clockwise around the rotating shaft 85 by the compression spring 210.

Figure 5:
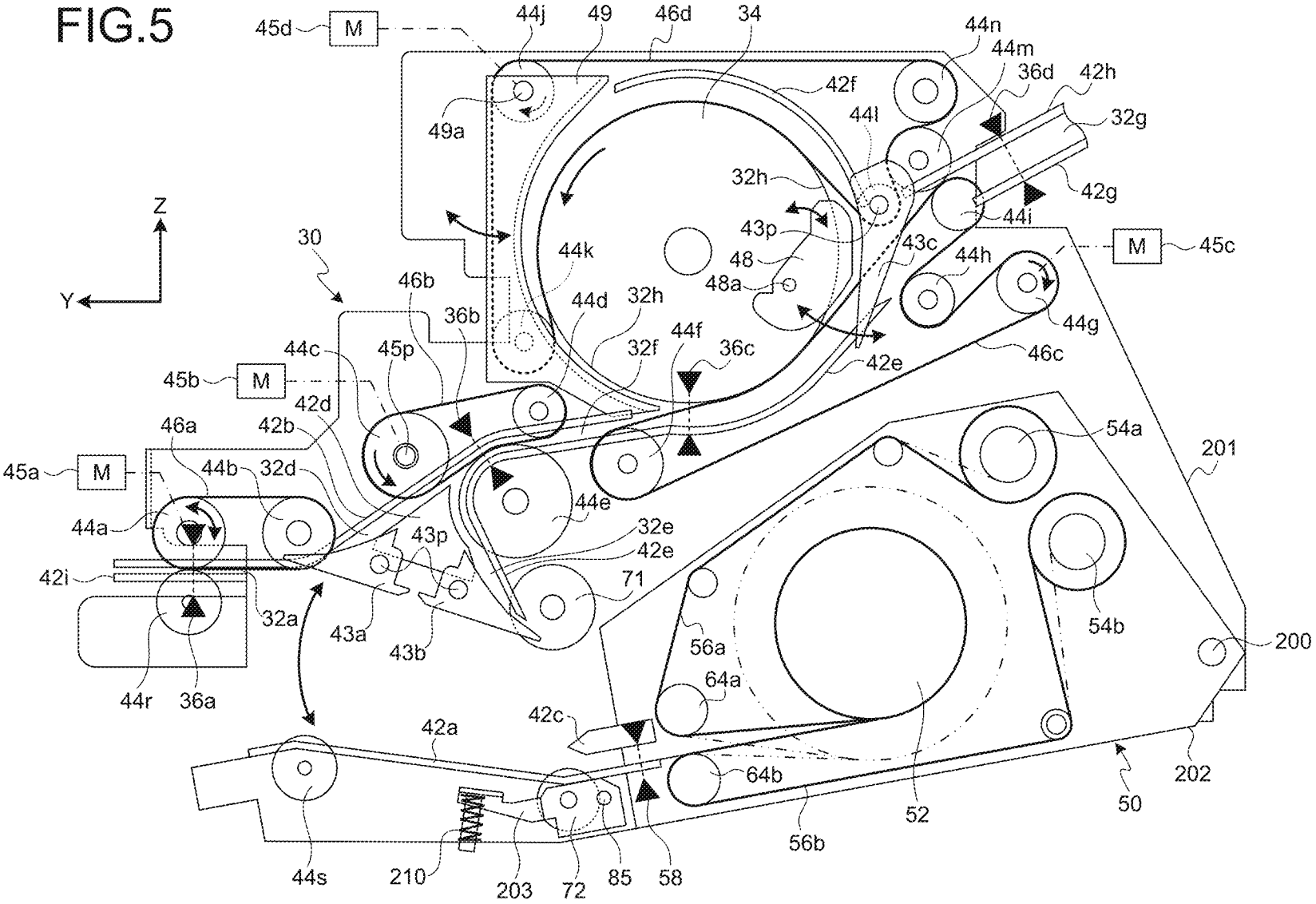
FIG. 5 is a schematic cross-sectional view illustrating the state where a second unit is pivoted.

When the banknote handling apparatus 10 handles banknotes, the first unit 201 and the second unit 202 are locked and fixed in the state shown in FIG. 4. Releasing the lock allows the second unit 202 to pivot around the support shaft 200. FIG. 5 is a schematic cross-sectional view illustrating the state where the second unit 202 is pivoted around the shaft 200. As shown in FIG. 5, the second unit 202 including the temporary storage unit 50, the third unit 203, and the second drive roller 72 is pivoted with respect to the first unit 201 including the first drive roller 71 and the stacking unit 30. That is, releasing the lock allows the first drive roller 71 and the second drive roller 72 to be separated from each other. In addition, releasing the lock allows the transport paths 32*b*, 32*c* formed before and after the first drive roller 71 and the second drive roller 72 to be opened.

When a foreign material or a banknote is jammed in the transport path 32*b* or 32*c*, or in a space between the first drive roller 71 and the second drive roller 72, the user of the banknote handling apparatus 10 can release the lock between the first unit 201 and the second unit 202, pivot the second unit 202 to expose the transport surface, and remove the foreign material or the banknote. Also, as for the other transport paths 32*a*, 32*d* to 32*h*, a foreign material or a banknote that is jammed in the path can be removed by manually rotating the rollers and the belts in the state shown in FIG. 5.

Figure 6B:
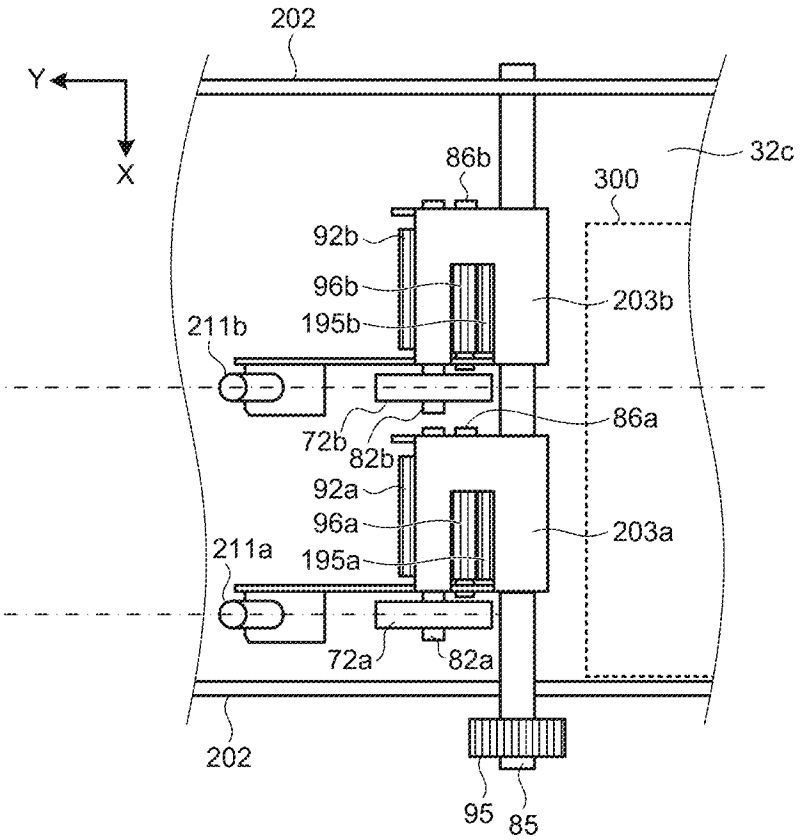
FIGS. 6A and 6B are external views illustrating arrangement of a first drive roller and a second drive roller on a transport path.
Figure 6A:
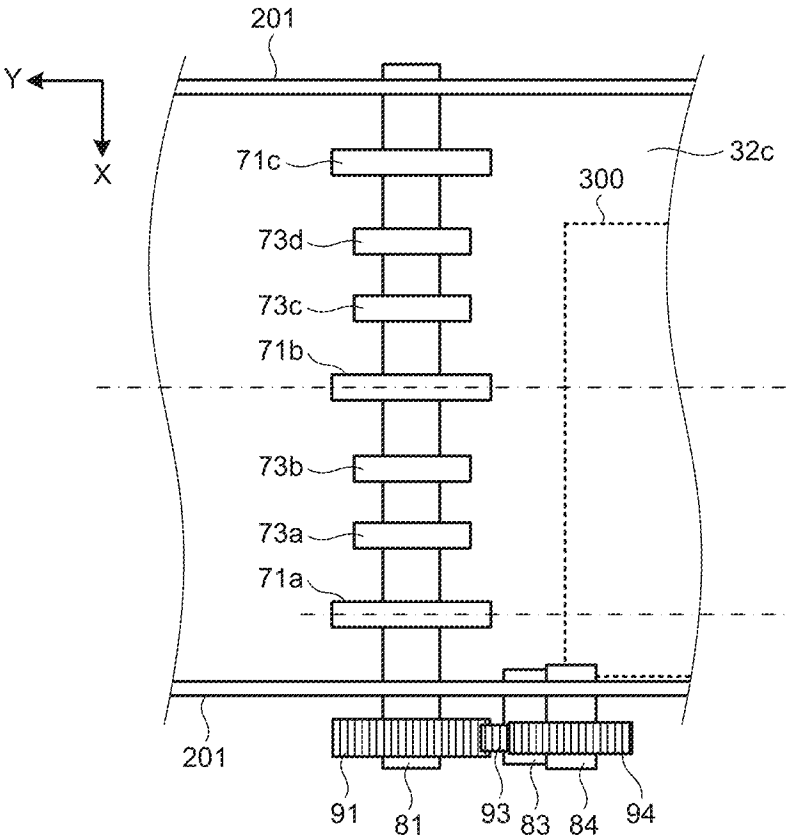

A plurality of first drive rollers 71 and a plurality of second drive rollers 72 are disposed in a transport path width direction orthogonal to the transport direction of banknotes transported on the transport path 32*c*. That is, there are the first drive rollers 71 and the second drive rollers 72 in a depth direction of the drawing (X-axis direction). FIGS. 6A and 6B are external views illustrating arrangement of the first drive rollers 71 and the second drive rollers 72 on the transport path 32*c*. FIG. 6A shows the positions at which the first drive rollers 71 (71*a* to 71*c*) are disposed, when the transport path 32*c* is viewed from the bottom side of the banknote handling apparatus 10 (in the Z-axis negative direction). FIG. 6B shows the positions at which the second drive rollers 72 (72*a*, 72*b*) are disposed, when the transport path 32*c* is viewed from the apparatus bottom side (in the Z-axis negative direction).

As shown in FIG. 6A, three first drive rollers 71*a* to 71*c* are disposed in a direction (X-axis direction) orthogonal to the transport direction (Y-axis direction) of a banknote 300. One first drive roller 71*b* is disposed at almost the center in the width direction (X-axis direction) of the transport path 32*c*. The first drive rollers 71*a*, 71*c* are disposed at opposed outer sides in the transport path width direction, with the first drive roller 71*b* interposed therebetween. The three first drive rollers 71*a* to 71*c* are fixed to one rotating shaft 81. The rotating shaft 81 is rotatably supported by the first unit 201.

The rotating shaft 81 is provided with four auxiliary rollers 73 (73*a* to 73*d*) which assist transport of the banknote 300. Specifically, two auxiliary rollers 73*a*, 73*b* are disposed between the first drive roller 71*a* and the first drive roller 71*b*, and two auxiliary rollers 73*c*, 73*d* are disposed between the first drive roller 71*b* and the first drive roller 71*c*. The diameter of the auxiliary roller 73 is smaller than the diameter of the first drive roller 71. The auxiliary roller 73 may be fixed to the rotating shaft 81 and rotated together with the first drive roller 71, or may be rotatably disposed on the rotating shaft 81 so as to rotate independently of the rotation of the first drive roller 71.

As shown in FIG. 6B, two third units 203 (203*a*, 203*b*) are disposed in a direction (X-axis direction) orthogonal to the transport direction (Y-axis direction) of the banknote 300. The two third units 203*a*, 203*b* are supported by one rotating shaft 85, swingably around the rotating shaft 85. Each third unit 203 is provided with a shaft portion 211 (211*a*, 211*b*). A compression spring 210 for urging the second drive roller 72 toward the first drive roller 71 is mounted to the shaft portion 211 (see FIG. 8).

A gear 195 (195*a*, 195*b*), a gear 96 (96*a*, 96*b*), and a gear 92 (92*a*, 92*b*) are disposed at positions on the back side of each third unit 203 drawn in FIG. 6B, that is, on the back face side of the drawing.

As shown in FIG. 6B, the rotating shaft 85 is rotatably supported by the second unit 202. The gears 195*a*, 195*b* are fixed to the rotating shaft 85. The rotating shaft 82*a* and the rotating shaft 86*a* are rotatably supported by the third unit 203*a*. The gear 92*a* is fixed to the rotating shaft 82*a*, and the gear 96*a* is fixed to the rotating shaft 86*a*. Likewise, the rotating shaft 82*b* and the rotating shaft 86*b* are rotatably supported by the third unit 203*b*. The gear 92*b* is fixed to the rotating shaft 82*b*, and the gear 96*b* is fixed to the rotating shaft 86*b*.

The banknote handling apparatus 10 is provided with a plurality of sets (or "conveyance sets"), each set including a compression spring 210, a second drive roller 72, rotating shafts 82, 86, gears 92, 96, 195, and a third unit 203 supporting these components. The third unit 203 has a U-shaped main body that supports the rotating shafts 82, 86. As shown in FIG. 6B, the second drive roller 72 is disposed outside the main body in the X-axis direction, while the gears 92, 96, 195 are disposed inside the main body in the X-axis direction. The shaft portion 211 is formed on an arm portion extending outward in the Y-axis positive direction from the main body supporting the second drive roller 72, and the compression spring 210 is mounted to the shaft portion 211.

The second drive roller 72*a* is fixed to the rotating shaft 82*a* that is axially supported by the third unit 203*a*. The second drive roller 72*b* is fixed to the rotating shaft 82*b* that is axially supported by the third unit 203*b*. The two second drive rollers 72*a*, 72*b* shown in FIG. 6B are disposed so as to correspond to the two first drive rollers 71*a*, 71*b* shown in FIG. 6A. That is, the first drive roller 71*a* and the second drive roller 72*a* are disposed opposed to each other with the transport path 32*c* interposed therebetween, and the first drive roller 71*b* and the second drive roller 72*b* are disposed opposed to each other with the transport path 32*c* interposed therebetween.

On the transport paths 16, 32 in the banknote handling apparatus 10, the banknote 300 is transported while being shifted one side (X-axis positive direction) in the transport path width direction as shown by a broken line in FIGS. 6A and 6B. Out of the three first drive rollers 71*a* to 71*c*, two first drive rollers 71*a*, 71*b* are disposed at a position where the banknote 300, which is transported while being shifted to one side, passes, and the remaining one first drive roller 71*c* is disposed at a position where the banknote 300 does not pass. The second drive rollers 72*a*, 72*b* are disposed so as to correspond to the first drive rollers 71*a*, 71*b* disposed at the position where the banknote 300 passes. That is, at the position where the banknote 300 does not pass, only the first drive roller 71*c* is disposed and a corresponding second drive roller is not disposed.

However, all the first drive rollers 71 may be provided with corresponding second drive rollers 72. For example, the width of each third unit 203 in the X-axis direction may be reduced by reducing the axial lengths of the rotating shafts 82, 86 and the gears 92, 96, 195, and three third units 203 may be disposed such that three second drive rollers 72 are opposed to three first drive rollers 71. Alternatively, the rotating shaft 82*b* of the third unit 203*b* shown in FIG. 6B may be extended in the transport path width direction (X-axis negative direction), and an additional second drive roller 72 may be disposed at a position opposed to the first drive roller 71*c*.

As shown in FIG. 6A, the gear 91 is fixed to the rotating shaft 81 that is axially supported by the first unit 201. The first unit 201 rotatably supports the rotating shaft 83 and the rotating shaft 84 that are disposed parallel to the rotating shaft 81. The gear 93 which meshes with the gear 91 is fixed to the rotating shaft 83. The gear 94 which meshes with the gear 93 is fixed to the rotating shaft 84. As shown in FIG. 6B, the gear 95 is fixed to the rotating shaft 85 that is axially supported by the second unit 202. In the state shown in FIG. 4, the gear 95 shown in FIG. 6B meshes with the gear 94 shown in FIG. 6A. When the second unit 202 is pivoted as shown in FIG. 5, meshing between the gear 95 and the gear 94 is released.

Figure 7A:
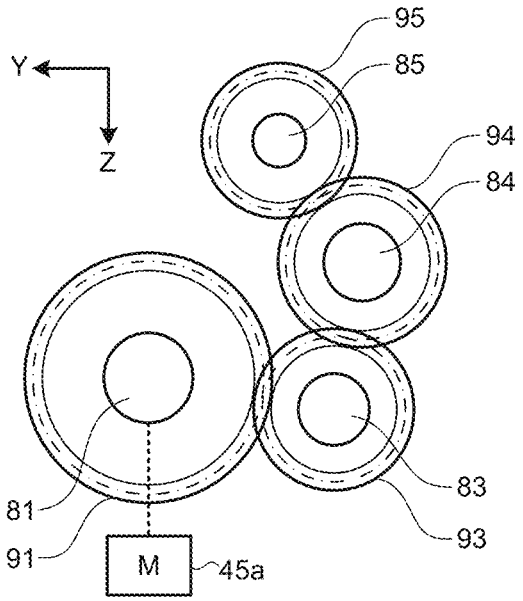
FIGS. 7A and 7B are schematic diagrams illustrating a method for driving the first drive roller and the second drive roller by gears.
Figure 7B:
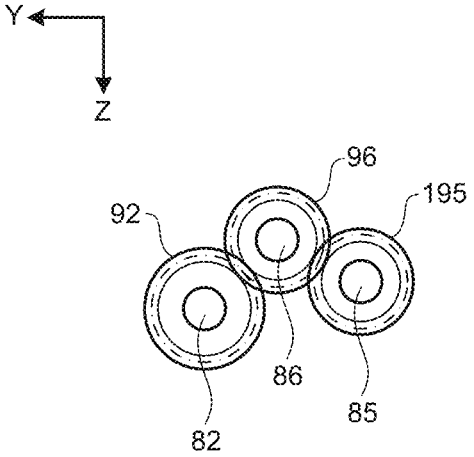

Next, rotation drive of the first drive roller 71 and the second drive roller 72 will be described. FIGS. 7A and 7B are schematic diagrams illustrating a method for driving the first drive roller 71 and the second drive roller 72 by the gears 91 to 96, 195. FIG. 7A shows the gears 91, 93, 94 disposed in the first unit 201 as shown in FIG. 6A, and the gear 95 disposed in the second unit 202 as shown in FIG. 6B. FIG. 7B shows gears 92, 96, 195 disposed in the third unit 203 as shown in FIG. 6B.

As shown in FIG. 7A, the rotating shaft 81 is connected to the motor 45*a* via a transmission mechanism. The motor 45*a* drives the belt 46*a* to rotate as shown in FIG. 4. The motor 45*a* also drives the rotating shaft 81 to rotate as shown in FIG. 7A via a gear mechanism or a belt mechanism. When the rotating shaft 81 rotates, the first drive roller 71 fixed to the rotating shaft 81 as shown in FIG. 6A rotates. The first drive roller 71 rotates in the same direction as the rotation direction of the rotating shaft 81 driven by the motor 45*a*.

When the rotating shaft 81 connected to the motor 45*a* as shown in FIG. 7A rotates, the gear 91 fixed to the rotating shaft 81 rotates. When the gear 91 rotates, the gear 93 in mesh with this gear 91 rotates. When the gear 93 rotates, the gear 94 in mesh with this gear 93 rotates. When the gear 94 rotates, the gear 95 in mesh with this gear 94 rotates. When the gear 95 rotates, the rotating shaft 85 to which the gear 95 is fixed rotates.

When the rotating shaft 85 rotates, the gear 195 fixed to the rotating shaft 85 as shown in FIG. 7B rotates. When the gear 195 rotates, the gear 96 in mesh with this gear 195 rotates. When the gear 96 rotates, the gear 92 in mesh with this gear 96 rotates. When the gear 92 rotates, the rotating shaft 82 to which this gear 92 is fixed rotates. When the rotating shaft 82 rotates, the second drive roller 72 fixed to the rotating shaft 82 as shown in FIG. 6B rotates. The second drive roller 72 rotates in a direction opposite to the rotation direction of the rotating shaft 81 connected to the motor 45*a*.

As described above, when the rotating shaft 81 is rotated by the motor 45*a*, the first drive roller 71 rotates in the same direction as the rotation direction of the rotating shaft 81, and the second drive roller 72 rotates in the direction opposite to the rotation direction of the rotating shaft 81. That is, the first drive roller 71 and the second drive roller 72 rotate in opposite directions.

Next, the third unit 203 will be described. FIG. 8 is a schematic diagram illustrating the third unit 203. In FIG. 8, (a) shows the banknote handling apparatus 10 as viewed from a lateral side (in the X-axis negative direction) as in FIG. 4. The third unit 203 is supported swingably around the rotating shaft 85 by the rotating shaft 85 axially supported by the second unit 202. The second drive roller 72 is fixed to the rotating shaft 82 axially supported by the third unit 203.

Figure 8A:
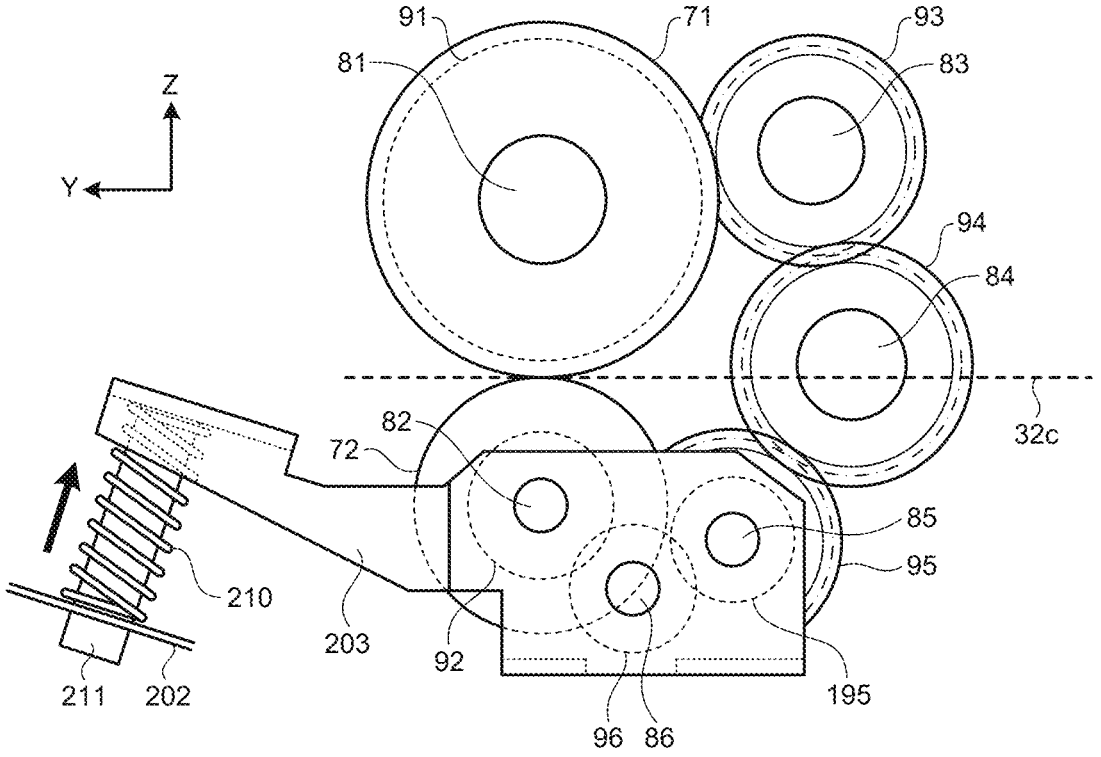
FIGS. 8A and 8B are schematic diagrams illustrating a third unit.
Figure 8B:
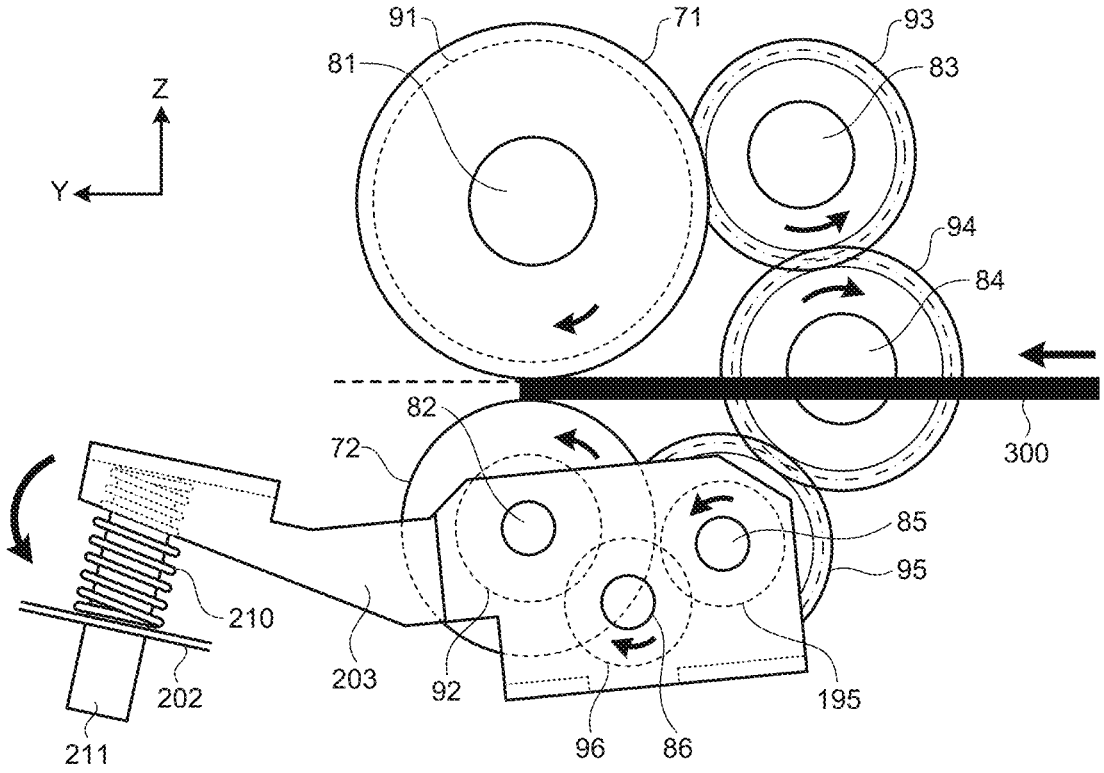

As shown in FIGS. 8A and 8B, the compression spring 210 is mounted to the shaft portion 211 formed in the third unit 203. An end of the shaft portion 211 projects outward from a through-hole formed in the second unit 202. This through-hole has a slot shape that is elongated in the Y-axis direction and has a width in the X-axis direction smaller than the outer diameter of the compression spring 210. Thus, the shaft portion 211 is allowed to move in the through-hole when the third unit 203 swings, while one end of the compression spring 210 is supported by the second unit 202.

The compression spring 210 in which the shaft portion 211 is inserted is mounted such that the third unit 203 functions as a spring seat at one end while the second unit 202 functions as a spring seat at the other end. The compression spring 210 urges the third unit 203 clockwise around the rotating shaft 85. As a result, the second drive roller 72 is urged toward the first drive roller 71. When no banknote 300 is present, the outer peripheral surface of the second drive roller 72 is in contact with the outer peripheral surface of the first drive roller 71 as shown in FIG. 8A.

The third unit 203 functions as a support member for movably supporting the second drive roller 72 such that a gap can be formed between the first drive roller 71 and the second drive roller 72. When the banknote 300 is fed out from the temporary storage unit 50 shown in FIG. 4, the banknote 300 is transported in the leftward direction (Y-axis positive direction) as shown in FIG. 8B. The banknote 300 causes the third unit 203 to pivot counterclockwise around the rotating shaft 85, and the compression spring 210 mounted to the shaft portion 211 contracts as shown in FIG. 8B. When the third unit 203 pivots counterclockwise, a gap is formed between the first drive roller 71 and the second drive roller 72. The banknote 300 passes through this gap. Even while the banknote 300 passes between the first drive roller 71 and the second drive roller 72, the outer peripheral surface of the first drive roller 71 continues to be in contact with one face of the banknote 300, and the outer peripheral surface of the second drive roller 72 continues to be in contact with the other face of the banknote 300, because the rollers 71 and 72 are urged by the compression spring 210.

When the motor 45*a* drives the rotating shaft 81 to rotate clockwise, the first drive roller 71 rotates clockwise and the second drive roller 72 rotates counterclockwise as shown by arrows in FIG. 8B. The gears 91 to 96, 195 are set such that the first drive roller 71 and the second drive roller 72 have the same circumferential speed. The first drive roller 71 in contact with the one face of the banknote 300 and the second drive roller 72 in contact with the other face of the banknote 300 are rotated at the same circumferential speed in different rotation directions, and therefore transport forces of the same magnitude act on both faces of the banknote 300 in the same direction. Thus, the banknote handling apparatus 10 can reliably transport the banknote 300 in a predetermined transport direction.

When the rear end of the banknote 300 in the transport direction has passed between the first drive roller 71 and the second drive roller 72, the third unit 203 is pivoted clockwise while being urged by the compression spring 210, and is restored from the state shown in FIG. 8B to the state shown in FIG. 8A.

The outer peripheral surface of the first drive roller 71 is made of rubber having a shore A hardness of 50° or lower, and the outer peripheral surface of the second drive roller 72 is made of rubber having a shore A hardness of 35° or lower. Rubber having a lower hardness tends to have a higher friction coefficient with respect to a banknote. Since the outer peripheral surfaces of the first drive roller 71 and the second drive roller 72 which contact with the banknote 300 is made of rubber, the friction force between each outer peripheral surface of the drive rollers 71, 72 and the face of the banknote 300 is increased, thereby preventing slippage. Thus, the banknote handling apparatus 10 can reliably transport the banknote 300. The rubber of the outer peripheral surface of the second drive roller 72 has a lower hardness than the rubber of the outer peripheral surface of the first drive roller 71, and therefore the transport force by the second drive roller 72 becomes greater than the transport force by the first drive roller 71. The second drive roller 72 is disposed beneath the transport path. When the banknote enters between the first drive roller 71 and the second drive roller 72, the leading end of the banknote may hit against the lower second drive roller 72. At this time, since the transport force of the second drive roller 72 is set to high, the leading end of the banknote is easily guided between the first drive roller 71 and the second drive roller 72. The shore A hardness of the outer peripheral surface of the second drive roller 72 may be equal to or smaller than 90% of the shore A hardness of the outer peripheral surface of the first drive roller 71. In order to further increase the transport force of the second drive roller 72, the shore A hardness of the outer peripheral surface of the second drive roller 72 may be equal to or smaller than 80% of the shore A hardness of the outer peripheral surface of the first drive roller 71.

In the present embodiment, the hardness of the rubber of the outer peripheral part 171*b* forming the outer peripheral surface of the first drive roller 71 is different from the hardness of the rubber of the outer peripheral part 172*b* forming the outer peripheral surface of the second drive roller 72, but the hardness may be the same. For example, rubber having a shore A hardness of 50° or lower may be used for both the outer peripheral part 171*b* of the first drive roller 71 and the outer peripheral part 172*b* of the second drive roller 72.

In the present embodiment, the six rotating shafts 81 to 86 and the seven gears 91 to 96, 195 are used as components of the drive mechanism for driving the first drive roller 71 and the second drive roller 72 to rotate. However, the number of rotating shafts and the number of gears are not particularly limited as long as the first drive roller 71 and the second drive roller 72 can be made to have the same circumferential speed, and can be made to rotate in opposite directions. Belts may be used instead of or in addition to the gears.

In the present embodiment, the single motor 45*a* is used as a driving unit for driving both the first drive roller 71 and the second drive roller 72. However, the configuration of the driving unit is not particularly limited as long as the first drive roller 71 and the second drive roller 72 can be made to have the same circumferential speed, and can be made to rotate in opposite directions. For example, a driving unit for driving the first drive roller 71 to rotate and a driving unit for driving the second drive roller 72 to rotate may be separately provided.

In the present embodiment, the first drive roller 71 and the second drive roller 72 are disposed on the transport path 32*c* which receives banknotes fed out from the tape-type temporary storage unit 50 shown in FIG. 4. Jamming of a banknote is likely to occur at a position where transport by the tapes 56*a*, 56*b* changes to transport by rollers or a position where transport by rollers changes to transport by belts, that is, at a position where the banknote transport manner is changed. The first drive roller 71 and the second drive roller 72 may be disposed such that a banknote, which passes through the position where the transport manner is changed, is transported by the first drive roller 71 and the second drive roller 72.

In order to receive a banknote fed out from the tape-type temporary storage unit 50, the height of the transport path 32*c* is higher than the transport path 32*b* present downstream in the transport direction. In other words, a transport space, in which a leading end of a banknote transported on the transport path can move in a direction perpendicular to the faces of the banknote, is increased. Specifically, the distance between the guide member 42*a* and the guide member 42*c* forming the transport path 32*c* is greater than the distance between the guide member 42*a* and the diverters 43*a*, 43*b* forming the transport path 32*b*. Jamming of a banknote is likely to occur at a position where the height of the transport path 32 transporting the banknote changes, that is, at a position where the extent of the transport space changes. The first drive roller 71 and the second drive roller 72 may be disposed such that a banknote, which passes through the position where the height of the transport path 32 changes, is transported by the first drive roller 71 and the second drive roller 72.

In the present embodiment, two rollers are disposed opposed to each other. However, the transport members are not limited to rollers. For example, a belt and a roller may be disposed opposed to each other to transport banknotes. When a roller, over which a belt is extended, and a roller disposed opposed to the belt with a transport path formed therebetween are driven to rotate at the same circumferential speed in opposite directions, occurrence of jamming of a banknote can be prevented as described above. Alternatively, for example, two belts may be disposed opposed to each other to transport banknotes. When a roller over which one belt is extended and a roller over which the other belt is extended are rotated to drive the two belts so as to rotate at the same circumferential speed in opposite directions, occurrence of jamming of a banknote can be prevented as described above.

Specifically, for example, in FIG. 4, the transport space is increased at a position where the transport path 32*d* and the transport path 32*e* join. The roller 44*c* over which the belt 46*b* is extended, and the roller 44*e* disposed opposed to the belt 46*b* are connected to each other by the drive mechanism including a plurality of rotating shafts and gears as described above. The number of teeth of each gear is set such that the circumferential speed of the belt 46*b* (the movement speed of the outer peripheral surface of the belt 46*b*) is equal to the circumferential speed of the roller 44*e*. When both the belt 46*b* and the roller 44*e* are driven to rotate by the motor 45*b*, occurrence of jamming of a banknote can be prevented as described above.

As described above, the banknote handling apparatus according to the present embodiment rotates two transport members, which are disposed opposed to each other with a transport path interposed therebetween, at the same circumferential speed in opposite directions. The opposed transport members are, for example, a roller and a roller, a roller and a belt, or a belt and a belt. When a banknote passes between the two transport members, the banknote handling apparatus causes the outer peripheral surface of one of the rotating transport members to be in contact with a front face of the banknote, and causes the outer peripheral surface of the other transport member to be in contact with a back face of the banknote. Thus, transport forces of the same magnitude act on both faces of the banknote in the same direction.

The two transport members are connected to each other by a drive mechanism including gears and/or belts. One of the transport members is supported movably in a direction away from the other transport member, so that a gap according to the thickness of the banknote can be formed between the two transport members. The two transport members are urged by the urging member such that the outer peripheral surfaces thereof contact with each other. Thus, even while the banknote passes through the gap formed between the two transport members, it is possible to maintain the state where the outer peripheral surface of the one transport member is in contact with the front face of the banknote while the outer peripheral surface of the other transport member is in contact with the back face of the banknote.

Since the outer peripheral surfaces of the transport members are made of rubber having a lower hardness than the material of the conventional transport members, slippage is prevented from occurring between the outer peripheral surfaces of the transport members and the faces of the banknote. Thus, the banknote handling apparatus can reliably transport the banknote, and prevent occurrence of jamming.

As described above, the sheet handling apparatus according to the present disclosure is useful for preventing occurrence of jamming of sheets in a transport path.

The invention claimed is:

1. A sheet handling apparatus, comprising:

a first transport member having an outer peripheral surface that rotates in a first direction in response to the first transport member being driven;

a second transport member having an outer peripheral surface that rotates in a second direction in response to the second transport member being driven, the second direction being opposite to the first direction;

a drive coupling that causes the first transport member and the second transport member to rotate in opposite directions with a same circumferential speed, the drive coupling including a first gear fixed to a rotation shaft of the first transport member, a second gear fixed to a rotation shaft of the second transport member, and a plurality of intermediate gears configured to transfer a drive force from a drive source to the first gear and the second gear;

the drive source configured to drive the first transport member and the second transport member to rotate via the drive coupling;

a support member disposed swingably around a rotation shaft of a third gear included in the plurality of intermediate gears, and configured to support the rotation shaft of the second transport member;

a bias member configured to urge the second transport member toward the first transport member; and a plurality of conveyance sets each of which includes at least one additional second transport member, at least one additional support member, and at least one additional bias member, wherein the second transport member disposed to oppose the first transport member such that a transport path that conveys a sheet is formed between the outer peripheral surface of the first transport member and the outer peripheral surface of the second transport member, the second transport member and the at least one additional second transport member being distributed along a common axis that is substantially orthogonal to a movement direction of the transport path, the common axis being in a width direction of the transport path, the second transport member, the support member, and the bias member being mounted together as a first conveyance set of the plurality of conveyance sets and rotatably mounted to a first shaft, the at least one additional second transport, member, the at least one additional support member, and the at least one additional bias member being mounted together as a second conveyance set of the plurality of conveyance sets and rotatably mounted to a second shaft, and the outer peripheral surface of the first transport member and the outer peripheral surface of the second transport member being configured to convey the sheet along the transport path in response to the first transport member and the second transport member being driven while a first face of the sheet remains in contact with the outer peripheral surface of the first transport member, and a second face of the sheet remains in contact with the outer peripheral surface of the second transport member.

2. The sheet handling apparatus according to claim 1, wherein at least one of the first transport member or the second transport member being a roller, or a belt extended over a plurality of rollers.

3. The sheet handling apparatus according to claim 1, further comprising:

a support member configured to movably support the second transport member; and a bias member configured to urge the second transport member toward the first transport member.

4. The sheet handling apparatus according to claim 1, wherein the first transport member and the second transport member are configured to transport the sheet through a position where two transport paths having different heights are connected to each other.

5. The sheet handling apparatus according to claim 1, wherein the first transport member and the second transport member are configured to transport the sheet through a position where two transport paths join each other.

6. The sheet handling apparatus according to claim 1, further comprising:

a storage/feeding unit configured to wind a tape together with the sheet onto a rotor to store the sheet around the rotor, and unwind the tape from the rotor to teed out the stored sheet from the rotor, wherein the first transport member and the second transport member are configured to receive and transport the sheet once fed out from the storage/feeding unit.

7. The sheet handling apparatus according to claim 6, further comprising:

an inlet on which the sheet is placed;

a feeder configured to feed out the sheet from the inlet to the transport path;

a detector configured to detect the sheet transported along the transport path; and a stacker configured to stack a plurality of sheets, which are to be returned outside from the inlet, so as to form a bundle, wherein the storage/feeding unit is a temporary storage unit configured to temporarily store the sheet once detected by the detector.

8. A sheet handling apparatus, comprising:

a first transport member having an outer peripheral surface that rotates in a first direction in response to the first transport member being driven; and a second transport member having an outer peripheral surface that rotates in a second direction in response to the second transport member being driven, the second direction being opposite to the first direction, wherein the second transport member disposed to oppose the first transport member such that a transport path that conveys a sheet is formed between the outer peripheral surface of the first transport member and the outer peripheral surface of the second transport member, and the outer peripheral surface of the first transport member and the outer peripheral surface of the second transport member being configured to convey the sheet along the transport path in response to the first transport member and the second transport member being driven while a first face of the sheet remains in contact with the outer peripheral surface of the first transport member, and a second face of the sheet remains in contact with the outer peripheral surface of the second transport member, wherein the transport path extends between respective outer peripheral surfaces of a plurality of other first transport members that are distributed along a first axis that is substantially orthogonal a movement direction of transport path and a plurality of other second transport members that are distributed along a second axis that is also substantially orthogonal to the movement direction of the transport path, the first axis and the second axis each being in a width direction of the transport path, the first transport member and the second transport member are configured to transport the sheet while the sheet is shifted to one side of a width direction of the transport path, the plurality of the other first transport members are distributed such that a subset are disposed a position where the sheet shifted to the one side passes and another subset are disposed at another position where the sheet shifted to the one side does not pass, the first transport member being a roller and at least two of the plurality of the other first transport members being rollers, each roller being distributed in a width direction of the transport path, the second transport member and only one other second transport member being arranged on one side of the width direction of the transport path with regard to a center of the width direction, and the only one other second transport member is disposed at only the position where the sheet shifted to the one side passes.

9. The sheet handling apparatus according to claim 8, wherein a number of the plurality of the other first transport members being different from a number of the plurality of the other second transport members.

10. A sheet handling apparatus, comprising:

a first transport member having an outer peripheral surface that rotates in a first direction in response to the first transport member being driven;

a second transport member having an outer peripheral surface that rotates in a second direction in response to the second transport member being driven, the second direction being opposite to the first direction, a storage/feeding unit configured to wind a tape together with a sheet onto a rotor to store the sheet around the rotor, and unwind the tape from the rotor to teed out the stored sheet from the rotor, wherein the first transport member and the second transport member are configured to receive and transport the sheet once fed out from the storage/feeding unit wherein the second transport member disposed to oppose the first transport member such that a transport path that conveys a sheet is formed between the outer peripheral surface of the first transport member and the outer peripheral surface of the second transport member, and the outer peripheral surface of the first transport member and the outer peripheral surface of the second transport member being configured to convey the sheet along the transport path in response to the first transport member and the second transport member being driven while a first face of the sheet remains in contact with the outer peripheral surface of the first transport member, and a second face of the sheet remains in contact with the outer peripheral surface of the second transport member;

an inlet on which the sheet is placed;

a feeder configured to feed out the sheet from the inlet to the transport path;

a detector configured to detect the sheet transported along the transport path; and a stacker configured to stack a plurality of sheets, which are to be returned outside from the inlet, so as to form a bundle, wherein the storage feeding unit is a temporary storage unit configured to temporarily store the sheet once detected by the detector, the inlet, the feeder, the stacker, and the first transport member are disposed in a first unit, the storage/feeding unit and the second transport member are disposed in a second unit, and the second unit is swingably supported by the first unit.

* * * * *